United States Patent [19]

Harada et al.

[11] Patent Number: 4,818,130

[45] Date of Patent: Apr. 4, 1989

[54] CHARACTER ERASABLE PRINTING APPARATUS INCLUDING SELECTIVE ERASING OF VARIABLE LENGTH UNDERLINE

[75] Inventors: Yuichi Harada, Nagoya; Hajime Kumazawa, Ichinomiya, both of Japan

[73] Assignee: Brother Kogyo Kabushiki Kaisha, Aichi, Japan

[21] Appl. No.: 121,880

[22] Filed: Nov. 17, 1987

[30] Foreign Application Priority Data

Nov. 19, 1986 [JP] Japan ..... 61-276252
Jan. 20, 1987 [JP] Japan ..... 62-11091
Apr. 17, 1987 [JP] Japan ..... 62-95696

[51] Int. Cl.[4] ..... B41J 29/36

[52] U.S. Cl. ..... 400/697; 400/17; 400/144.2; 400/304

[58] Field of Search ..... 400/16, 17, 63, 144.2, 400/212, 304, 111, 695, 696, 697, 697.1

[56] References Cited

U.S. PATENT DOCUMENTS 3,513,968 5/1970 Hanson ..... 400/111 X
3,630,336 12/1971 Johnson et al. ..... 400/17
3,780,846 12/1973 Kolpek et al. ..... 400/697.1 X
4,084,680 4/1978 Deetz ..... 400/17
4,307,971 12/1981 Kane, III et al. ..... 400/697
4,381,553 4/1983 Ferguson ..... 400/17 X
4,388,005 6/1983 Wehking et al. ..... 400/144.2
4,392,758 7/1983 Bowles et al. ..... 400/17 X
4,472,073 9/1984 Valle et al. ..... 400/185
4,500,216 2/1985 Demonte et al. ..... 400/17 X
4,533,267 8/1985 Kurachi et al. ..... 400/214
4,545,693 10/1985 Bartlett et al. ..... 400/696 X
4,585,362 4/1986 Gray ..... 400/212 X
4,629,341 12/1986 Brinkmann et al. ..... 400/17
4,687,356 8/1987 Matsui et al. ..... 400/144.2
4,692,045 9/1987 Makita ..... 400/304 X

FOREIGN PATENT DOCUMENTS 0147376 8/1985 Japan ..... 400/697
2108299 5/1983 United Kingdom ..... 400/697

*Primary Examiner*—Ernest T. Wright, Jr.
*Attorney, Agent, or Firm*—Barnes & Thornburg

[57] ABSTRACT

A character erasable printing apparatus is designed to erase a character or an underline in plural times of erasing action by moving the printing head, and to print a character by a single printing action.

Therefore, when an underlined character is erased together with its underline, and a correct character is printed together with an underline, the underline is interrupted.

Disclosed are, to pervent such interruption of the underline, a character erasable printing apparatus capable of erasing only the character without erasing the underline when the underline mode is being set, a character erasable printing apparatus capable of erasing only the character without erasing the underline when erasing a character adjacent to an underlined character, and a character erasable printing apparatus capable of erasing the underline without moving the printing head when erasing an underline of a character adjacent to an underlined character.

15 Claims, 13 Drawing Sheets

(a) ABC (b) A C (c) A C (d) ADC (a) ABC (b) A C (c) ADC

Fig.12 - Prior Art -

CHARACTER ERASABLE PRINTING APPARATUS INCLUDING SELECTIVE ERASING OF VARIABLE LENGTH UNDERLINE

BACKGROUND OF THE INVENTION

This invention relates to a character erasing mechanism of a printing apparatus, and more particularly to a character erasing mechanism for erasing printed characters including an underline.

Generally, character erasable electronic typewriters and other printing apparatus are furnished with an automatic correction mechanism for erasing wrong printed characters by erasure key operation. Such automatic correction mechanism erases characters by the coverlap method by adhering a correction fluid on the wrong printed characters, or the lift-off method for lifting off the printed ink by a correction ribbon, and recently the lift-off method is generally employed.

In this lift-off method which is designed to erase the wrong printed character by peeling off the ink printed on the printing paper by means of a correction ribbon, it is desired that the printing element be located in the same position when printing and when erasing. That is, if the position of the printing element at the time of erasing is deviated from that at the time of printing, a certain portion of the printed ink is not peeled off. To erase the wrong printed character completely, it is desired that the printing element be exactly on the same location when printing and when erasing. However, a complicated and expensive mechanism is required to attain such positional accuracy.

Conventionally, therefore, for example in the Japanese Patent Publication (examined) No. 56-46992 (this application corresponds to U.S. Pat. No. 4,307,971) and Japanese Patent Publication (non-examined) No. 60-147376, in the printing apparatus applying the lift-off method, it was proposed to peel off the ink of a wrong printed character completely by repeating the erasing action while moving the carriage slightly right and left.

In such conventional printing apparatus, when an underlined character is printed in the automatic underline mode, the underline can be erased at the same time when the underlined character is erased by the automatic correction function.

At this time, the printing apparatus, as stated above, erases the wrong printed character by moving the carriage slightly right and left, and it also moves the carriage right and left when erasing an underline, and the wrong printed character can be completely erased, but the underline is erased more than the erased character portion by the extent of moving the carriage slightly. As a result, as shown in FIG. 12, after erasure, when a correct underlined character (a character H) is printed, the underline 80 has a gap 81 corresponding to the extent of moving the carriage slightly so as to be discontinuous, and a beautiful underline printing consecutive with the preceding and succeeding underlines cannot be achieved.

SUMMARY OF THE INVENTION

It is hence a primary object of the present invention to present a character erasable printing apparatus capable of correcting and printing characters and underlines beautifully by preventing breakage of an underline when correcting and printing an underlined character. Another object of the present invention is to save the consumption of the erasure ribbon and the printing ribbon.

A character erasable printing apparatus according to the first aspect of the present invention comprises: input means for inputting data regarding a character or a symbol, printing means having a printing head movable in a predetermined printing direction, and operative for printing a character or a symbol corresponding to an input data on a printing medium; automatic underline mode setting means for setting an automatic unerline mode in the printing means; print data memory means for storing code data and underline data of the characters, symbols and underline printed by the printing means so as to correspond to their printing positions; reading means for reading out the code data of the characters and symbols and underline data stored in the print data memory means; erasing means for erasing a character or symbol from the printing medium, when an erasure command is inputted from the input means, by operation of the printing means according to the code data being read out by the reading means; and erasure control means for controlling the reading means to read out only the code data of the printed character or symbol corresponding to the present printing position of the printing head from the print data memory means, when the erasure command is received in the automatic underline mode, and for controlling the erasing means to erase the printed character or symbol corresponding to the read-out code data in such a manner that the printed underline remains unerased.

A character erasable printing apparatus according to the second aspect of the present invention comprises: input means; and print data memory means same as in the first aspect; printing means having a printing head movable in a predetermined printing direction and including plural printing types and a printing hammer, and a printing ribbon for printing a character or symbol corresponding to an input data on a printing medium; present position memory means for storing a present position of the printing head so as to correspond to the printing position; erasing means for erasing a character or symbol from the printing medium by hammering the same printing type as the character or symbol at the present position of the printing head by the printing hammer through an erasure ribbon, at the present position and the positions where the printing head is moved slightly behind and ahead, on the basis of the data of the print data memory means and the data of the present position memory means, when an erasure command is inputted from the input means; judging means for reading out the underline data of the present position of the printing head and at least one position of one stroke upper printing position and one stroke lower printing position, from the print data memory means on the basis of the data of the present position memory means when the erasure command is inputted, and for judging whether or not printed characters or symbols of these positions are underlined; and erasure control means for controlling the erasing means to erase only the printed character without erasing the underline, if the printed character is underlined, when at least one of the printed characters at both sides of the printed character is judged to be underlined by the judging means.

A character erasable printing apparatus according to the third aspect of the present invention comprises: input means, printing means, print data memory means, present position memory means and erasing means same as in the second aspect; search means for searching the underline data of the present position of the printing head and at least one position of one stroke upper printing position and one stroke lower printing position from the print data memory means on the basis of the data of the present position memory means when the erasure command is received; and underline erasure control means for controlling the erasing means to erase the underline at the present position without moving the printing head slightly behind and ahead when the underline is detected at the present position of the printing head, and said one stroke upper printing position or said one stroke lower printing position by the search means.

In the character erasable printing apparatus of the first aspect, when the erasure control means receives an erasure command in the automatic underline mode, erasure control means controls the reading means to read out the code data of the printed character corresponding to the present printing position of the printing head from the print data memory means, and controls the erasing means to erase only the printed character corresponding to the read-out code data. As a result, the underline attached to the erased printed character remains without being erased.

In the character erasable printing apparatus of the second aspect, when the judging means receives an erasure command, the judging means reads out the underline data of the present position of the printing head and its one stroke upper printing position and its one stroke lower printing position from the print data memory means on the basis of the data of the present position memory means, and the judging means judges whether or not printed characters or symbols of these positions are underlined. When at least one of the printed characters at both sides is judged to be underlined by the judging means, the erasure control means controls the erasing means to erase only the printed character, if the printed character at the present position is underlined, without erasing the underline.

In the character erasable printing apparatus of the third aspect, when the search means receives an erasure command, the search means searches the underline data of the present position of the printing head, its one stroke upper printing position and its one stroke lower printing position from the print data memory means on the basis of the data of the present position memory means. When the underline data is detected from the present position of the printing head, its one stroke upper printing position or its one stroke lower printing position by the search means, the underline erasure control means controls the erasing means to erase the underline at the present position without moving the printing head slightly behind and ahead.

According to the character erasable printing apparatus of the present invention, when the automatic underline mode is set, or when at least one of the printed characters at one stroke upper printing position or one stroke lower printing position of the present position of the printing head is underlined, only the character is erased without erasing the underline, so that the characters may be corrected and printed beautifully without interrupting the underline when correcting and printing.

Besides, when at least one of the printed characters at one stroke upper printing position or one stroke lower printing position of the present position of the printing head is underlined, the underline can be erased without moving the printing head, so that the underline can be corrected and printed beautifully without interrupting the underline when correcting and printing.

BRIEF DESCRIPTION OF THE DRAWINGS

FIG. 1 to FIG. 5 relate to a first embodiment; in which,

FIG. 1 is a plan view of a typewriter,

FIG. 2 is a block diagram of the control system of the typewriter,

FIG. 3 is a diagram showing the printing and erasing status, and

FIG. 4 and FIG. 5 are flow charts of the routine of the character erasing control.

FIG. 6 to FIG. 11(*c*) relate to a second embodiment; in which

FIG. 6 is a perspective view of a typewriter,

FIG. 7 is a block diagram of the control system of the typewriter.

FIGS. 8(*a*) and 8(*b*) are flow charts of the routine of the character erasure control in a first example, FIGS. 9(*a*), 9(*b*), 9(*c*), 9(*d*), 10(*a*), 10(*b*) and 10(*c*) are diagrams showing the printing and erasing status, and FIGS. 11(*a*), 11(*b*) and 11(*c*) are flow charts of the routine of the character erasure control in a second example, and FIG. 12 is a diagram showing the erasing status in a prior art.

DESCRIPTION OF THE PREFERRED EMBODIMENTS

[First Embodiment]

Referring now to FIG. 1 to FIG. 5, a first embodiment of the present invention is described below.

Figure 1:
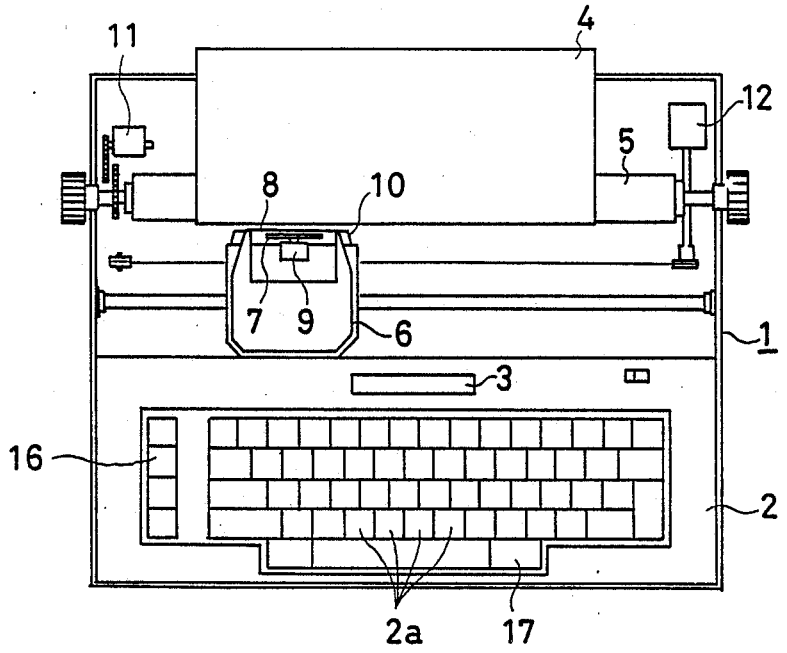
FIG. 1 to FIG. 11(*c*) relate to a character erasable printing apparatus representing embodiments of the present invention.

On the top surface of an electronic typewriter 1 as shown in FIG. 1, a keyboard 2 having plural character keys 2*a*, is provided, and a display 3 to display printed characters is installed behind it, and further behind the display 3 is disposed a platen 5 for mounting a printing paper 4. A carriage 6 is provided before the platen 5, and a printing hammer 9 for printing a character on the printing paper 4 through a printing ribbon 8 by hammering the printing type on a type wheel 7 is mounted on the carriage 6. Beneath the printing ribbon 8, a correction ribbon 10 is disposed parallel to the printing ribbon 8. The type wheel 7 and printing hammer 9 constitute the printing head.

The platen 5 is driven rotatively by a line feed motor 11 (hereinafter, denoted LF motor) installed at its left backward position, and the carriage 6 is moved reciprocatively along the printing line by a carriage drive motor 12 installed at the right backward position of the platen 5. The type wheel 7 is rotated by a type selection motor 13, and the printing type corresponding to an operated character key 2*a* is located at the printing position. The printing ribbon 8 and correction ribbon (erasure ribbon) 10 are supported by known holders as disclosed in U.S. Pat. Nos. 4,472,073 and 4,533,267, and the holders are oscillated up and down by a ribbon lift motor 14 through a known cam mechanism as likewise disclosed in the above-mentioned U.S. patents, so that the printing ribbon 8 or correction ribbon 10 is located at the printing position. By actuation of the ribbon lift motor 14, the correction ribbon 10 is lifted up. The printing ribbon 8 is shifted by a ribbon drive motor 15.

The keyboard 2 comprises an automatic underline key 16 for setting the automatic underline mode for printing an underline automatically beneath the characters being printed, and a correction key 17 for correcting a wrong printed character (printed character to be corrected) by means of the correction ribbon 10. The correction key 17 is designed to issue a character erasure signal to a CPU 18 which is described below when it is pressed down.

Figure 2:
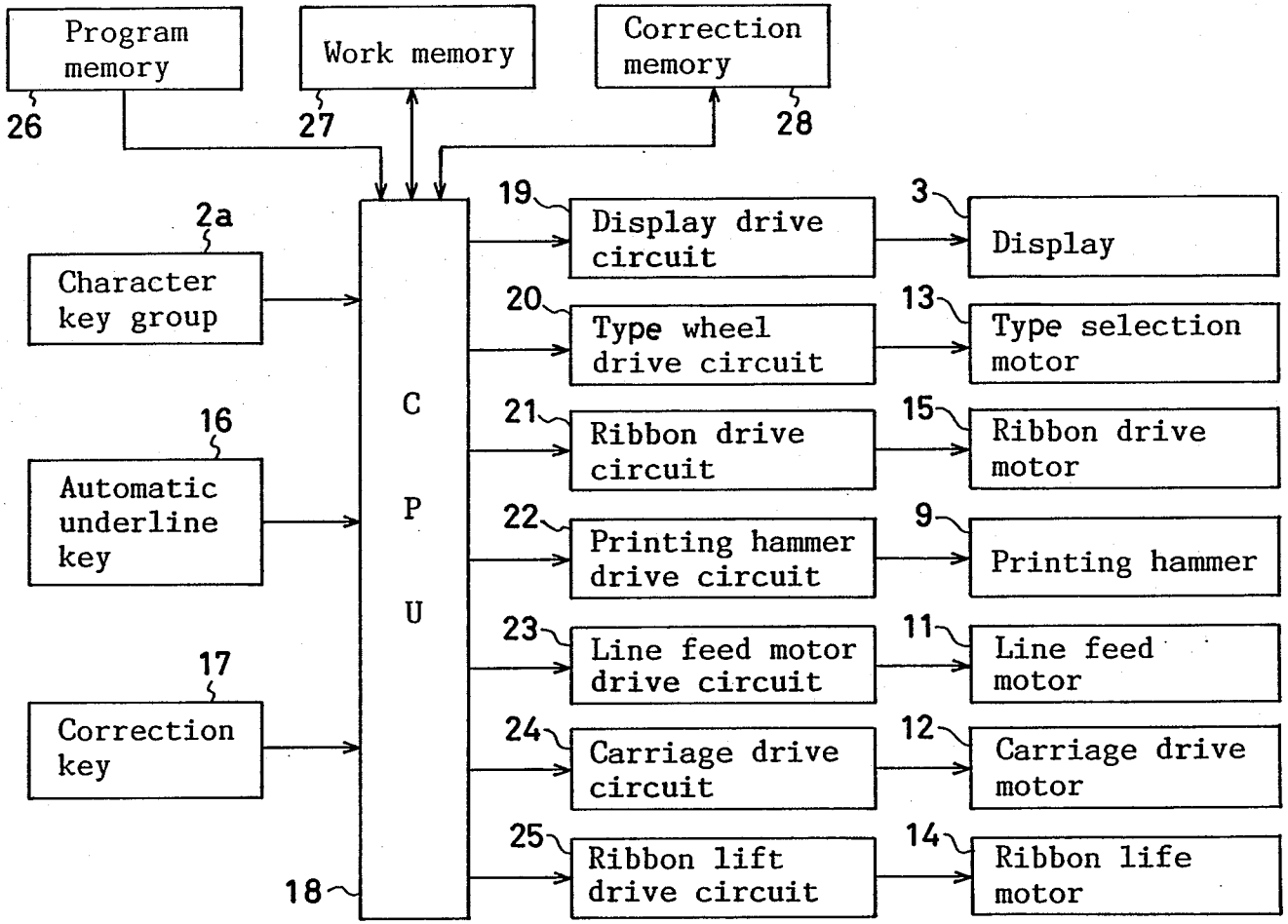

The electric construction of the character erasing mechanism of this typewriter 1 is now described with reference to FIG. 2.

A central processing unit (CPU) 18 as reading means and control means is connected with character keys 2*a* and a display drive circuit 19, and when character data is input from a character key 2*a*, the CPU 18 displays the corresponding characters in the display 3 through the display drive circuit 19. The CPU 18 is connected with a type wheel drive circuit 20 for rotating the type selection motor 13, a ribbon drive circuit 21 for rotating the ribbon drive motor 15, a printing hammer drive circuit 22 for driving the printing hammer 9 to make a printing action, a line feed motor drive circuit 23 for rotating the line feed motor 11, a carriage drive circuit 24 for rotating the carriage drive motor 12, a ribbon lift drive circuit 25 for rotating the ribbon lift motor 14, and an alarm circuit 34 for sounding a buzzer 35 in the event of wrong key operation. The CPU 18 is constituted to print the characters displayed on the display 3 sequentially on the printing paper 4 through the drive circuits 20 to 25.

The CPU 18 is further connected with a program memory 26 which stores the control program for controlling this electronic typewriter 1, and a work memory 27 for temporarily storing the result of operation of the CPU 18. The work memory 27 also stores the data to show whether or not the automatic underline mode is being set by pressing the automatic underline key 16 connected to the CPU 18.

In a correction memory 28 as a printing data storing means connected to the CPU 18, the character data of the characters printed at specified positions of the printing paper 4 by operation of character keys 2*a* are stored. Each character data is composed of two bytes (16 bits), and the character code corresponding to the printed character is stored in the upper byte, while the presence or absence of underline or character modifying flag such as boldface printing, the shift stroke of carriage 6, impact force of printing hammer 9 and other data are stored in the lower byte.

When a character erasure signal is input into the CPU 18 from the correction key 17 connected thereto, the printed character data at a specified position (the position of the printing hammer 9) on the printing paper 4 are read out from the correction memory 28. At the same time, the CPU drives the ribbon lift motor 14 through the ribbon drive circuit 25, and locates the correction ribbon 10 between the type wheel 7 and printing paper 4 in place of the printing ribbon 8, and also rotates the type selection motor 13 through the type wheel drive circuit 20 on the basis of the data being read out, thereby disposing the printing type corresponding to the character code at the printing position. Finally the CPU 18 commands to erase the printed character by striking the printing type in plural printing actions while moving the carriage 6 slightly right and left through the correction ribbon 10 by means of the printing hammer 9.

Figure 4:
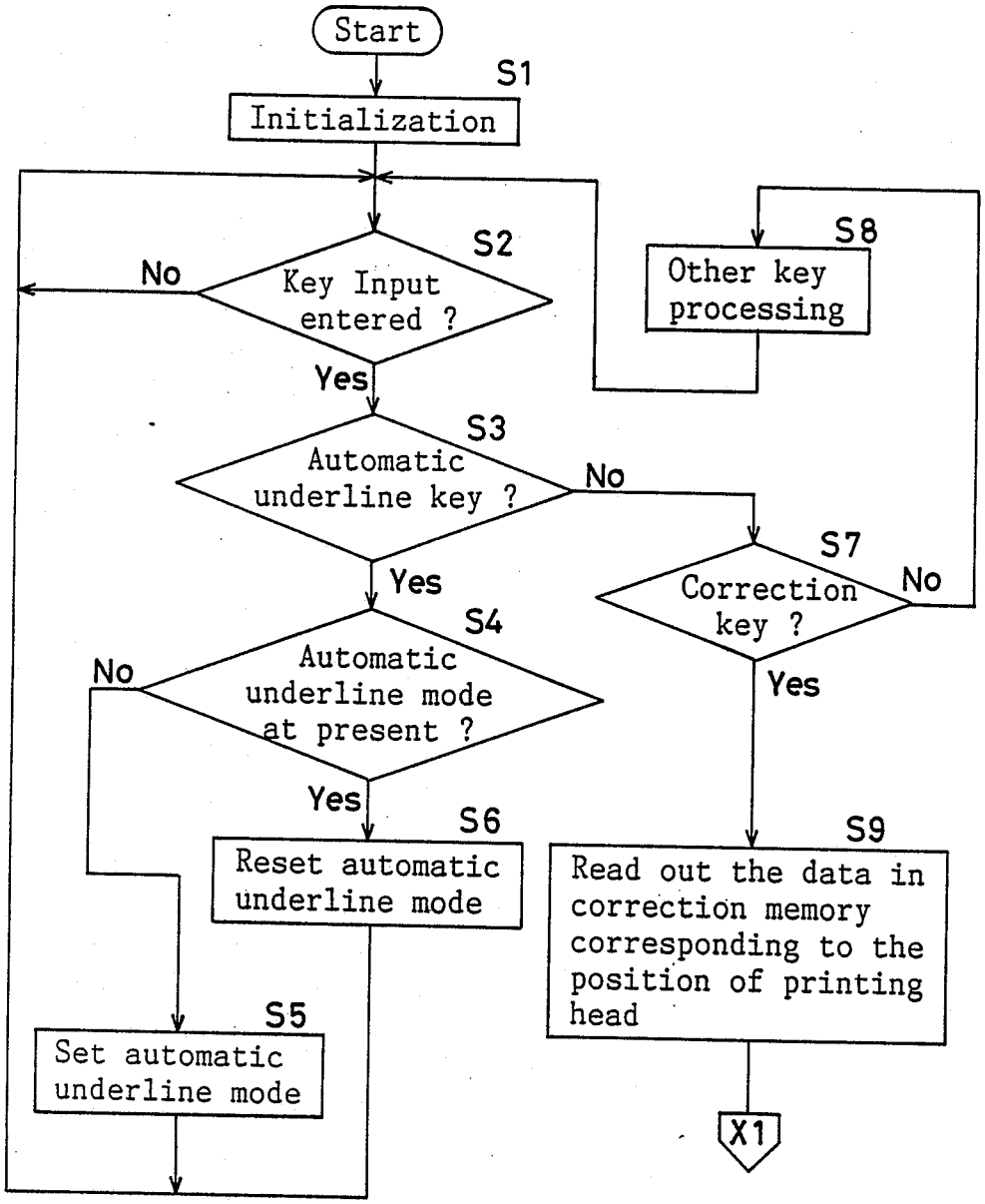
Figure 5:
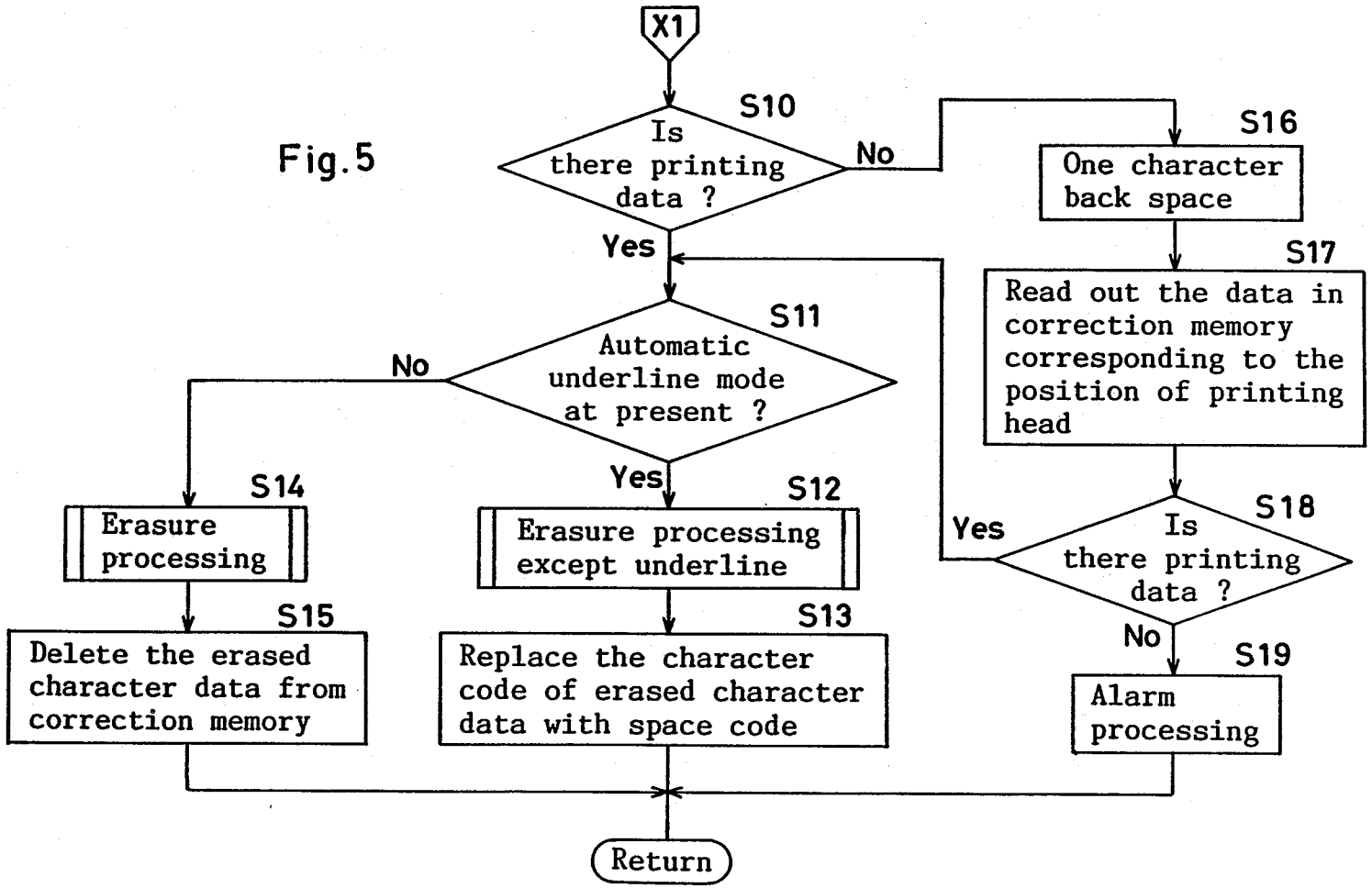

The function of the thus composed character erasing mechanism of the typewriter 1 is further described below with reference to the flow charts in FIG. 4 and FIG. 5.

First, when the operator turns on the power, the CPU 18 initializes by detecting the origin of the type wheel 7 and the carriage 6 and resetting the work memory 27 and the correction memory 28 (step 1; abbreviated S1, as are subsequent steps designated S2, S3, etc.), and waits for key input (S2). When a key input is made, the CPU 18 judges whether the key input is the operation of automatic underline key 16 or not (S3).

When the automatic underline key 16 is operated, the CPU 18 judges whether the automatic underline mode has been already set or not (S4). If at this time, the automatic underline mode has not been already established, the CPU 18 stores the information to set the automatic underline mode in the work memory 27 (S5), and it waits for a new key input (S2). To the contrary, if the automatic underline mode has been already stored in the work memory 27, the CPU 18 stores the information to cancel the automatic underline mode in the work memory 27 (S6). Therefore, every time the automatic underline key 16 is pressed down, the automatic underline mode and the ordinary mode are changed over alternately.

In the automatic underline mode, when the operator operates a character key 2*a*, the CPU 18 judges whether it is operation other than the automatic underline key 16 (S3), and judges whether it is correction key 17 or not (S7). At this time, since the character key 2*a* has been pushed, the CPU 18 processes printing operation while adding an underline 32 to the character 31 corresponding to the character key 2*a* as shown FIG. 3 (S8). In this processing, the CPU 18 stores the printed character data, that is, the character code and the underline information data, in the correction memory 28.

Figure 3:
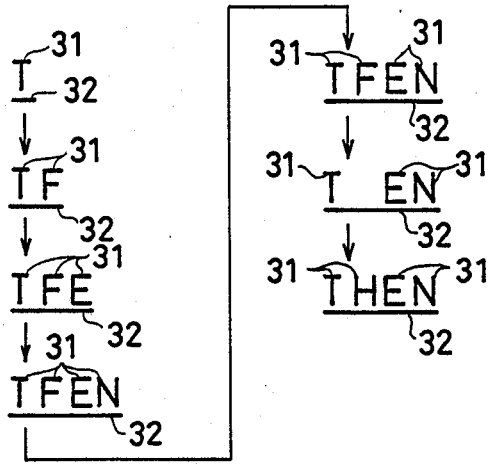

Here, for example, if the operator prints "TFEN" instead of "THEN" and wants to correct F to H, the operator operates the back space key 33 to adjust the printing hammer 9 to the position of "F" to be corrected (S2, S3, S7, S8). Next, when the correction key 17 is pressed down, the CPU 18 reads out the printed character data corresponding to the position of the printing hammer 9 from the correction memory 28 (S9), and judges whether there is printed character data corresponding to the printing position or not (S10). At this time, the data "F" is present in the correction memory 28, and then the CPU 18 judges whether the automatic underline mode is in effect or not (S11). Since the automatic underline mode is set at present, the CPU 18 drives the type selection motor 13, printing hammer 9, ribbon lift motor 14 and carriage drive motor 12 on the basis of the character code of the printed character data being read out in order to erase only the character "F" to be corrected, except for its underline 32, and carries out plural times of erasing action while moving the carriage 6 slightly right and left, so that the character "F" is erased from the printing paper 4 as shown in FIG. 3 (S12).

Then, the CPU 18 replaces the character code (the upper byte) of the printed character data in the correction memory 28 corresponding to the erased character "F" with a space code (S13), and waits for a new key operation. Of the correction character data, the lower byte is left as it is. At this printing position, when the operator pushes a character key 2*a* corresponding to "H", the CPU 18 judges same as mentioned above (S2, S3, S7), and commands printing operation of the correct character "H" in the erased position, and finishes a correction printing (S8). At this time, the memory region replaced by the space code of the correction memory 28 is replaced by the character code of "H" by the CPU 18.

Meanwhile, when judging whether the automatic underline mode has been set or not, if the CPU 18 judges that it is not automatic underline mode (S11), both the wrong character "F" and its underline are erased from the printing paper 4 on the basis of the character code of the printed character data and the underline information data being read out from the correction memory 28 (S14). The CPU 18 deletes the printed character data in the correction memory 28 corresponding to the erased character "F", and waits for a new key operation for correction printing or the like (S15).

Therefore, in this electronic typewriter 1, in the case of the automatic underline mode, if there is underline information data in the character data in the correction memory 28, the CPU 18 invalidates such data in the erasure processing (S12) and does not erase the underline, so that "THEN" can be printed without interrupting the underline. Furthermore, since the underline is not erased, it is not necessary to print the underline again, so that the consumption of the printing ribbon 8 may be saved.

In S10, when the CPU 18 judges that there is no printed character data in the printing position corresponding to the printing hammer 9 or space code is stored in the correction memory 28, one stroke back space is carried out by the carriage drive motor 12 (S16), and the printed character data is read out from the correction memory 28 corresponding to the printing position after the back space (S17). If there is printed character data at this printing position (S18), the CPU 18 conducts the same processing (S11 to S15), and if there is not (S18), it sounds the buzzer 35 (S19), and waits for a new key operation.

This invention, however, is not limited to the above embodiment, but may be freely varied without departing from the true spirit of this invention.

[SECOND EMBODIMENT]

(FIG. 6 to FIGS. 11(*a*), 11(*b*) and 11(*c*)

Figure 6:
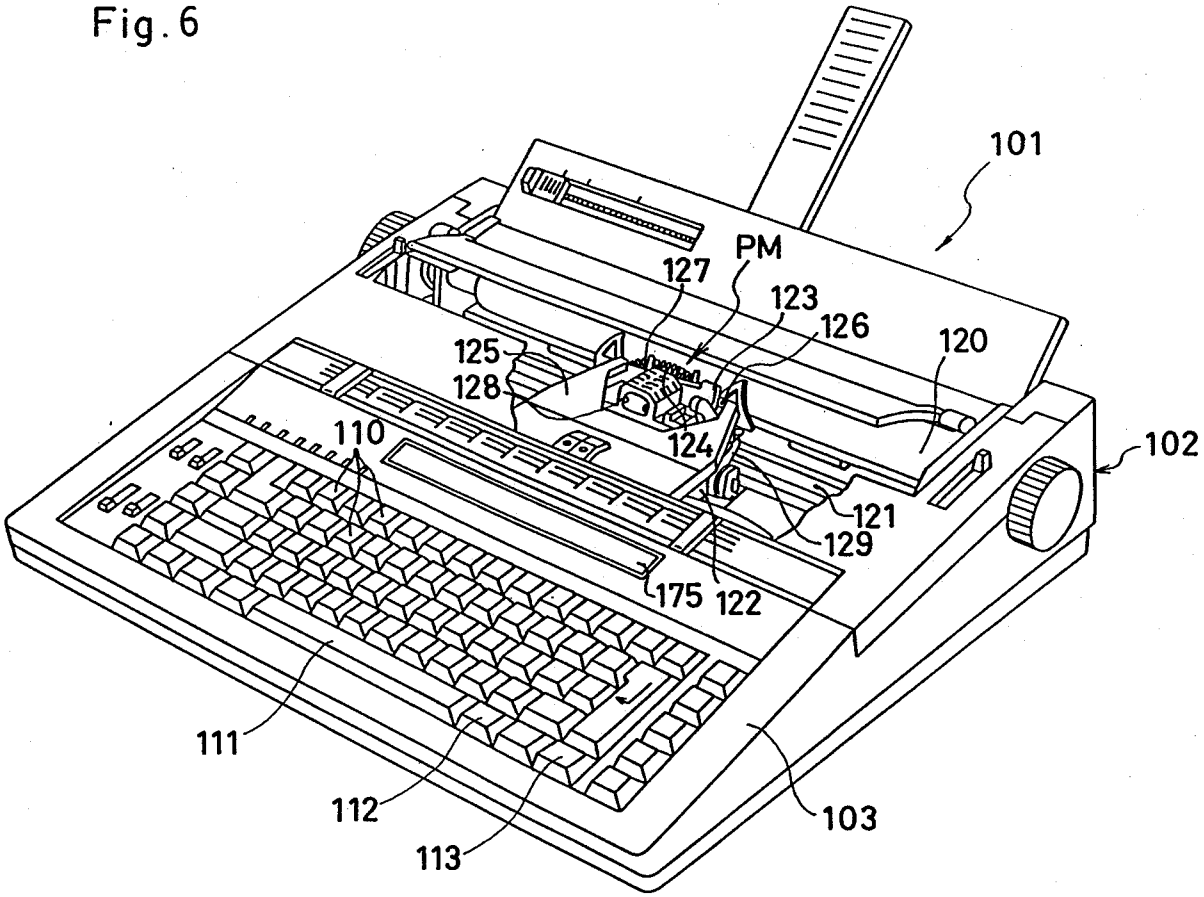

As shown in FIG. 6, a keyboard 103 is disposed in the front part of a main body frame 102 of an electronic typewriter 101, and a printing mechanism PM is disposed in the main body frame 102 behind the keyboard 103, and a liquid crystal display 175 for one line is provided in the rear part of the keyboard 103 in order to display the input characters and symbols.

The keyboard 103 comprises, same as in an ordinary typewriter, character keys 110 including alphabet keys, numeral keys and symbol keys, a space key 111, an erasure key 112 for erasing a printed character, an automatic underline key 113 for printing an underline automatically, and other function keys 114, 115.

The printing mechanism PM at least comprises a platen 120 for feeding a printing paper 161, its drive motor 130 and its drive circuit 131, a carriage 122 supported by a guide 121 parallel to the platen 120, its drive motor 132 for driving left and right reciprocatively and its drive circuit 133, a type wheel 127 held in a wheel cassette 123, its drive motor 134 and its drive circuit 135, a printing ribbon 126 held in a ribbon cassette 125, its drive motor 136 and its drive circuit 137, a printing hammer 124 for hammering a printing type of the type wheel 127, its drive solenoid 128 and its drive circuit 138, and a known ribbon chageover mechanism as disclosed in U.S. Pat. Nos. 4,472,073 and 4,533,267 for selectively locating the printing ribbon 126 or correction ribbon 129 at the printing position, and this printing mechanism PM is similar to the one in an ordinary electronic typewriter.

Figure 7:
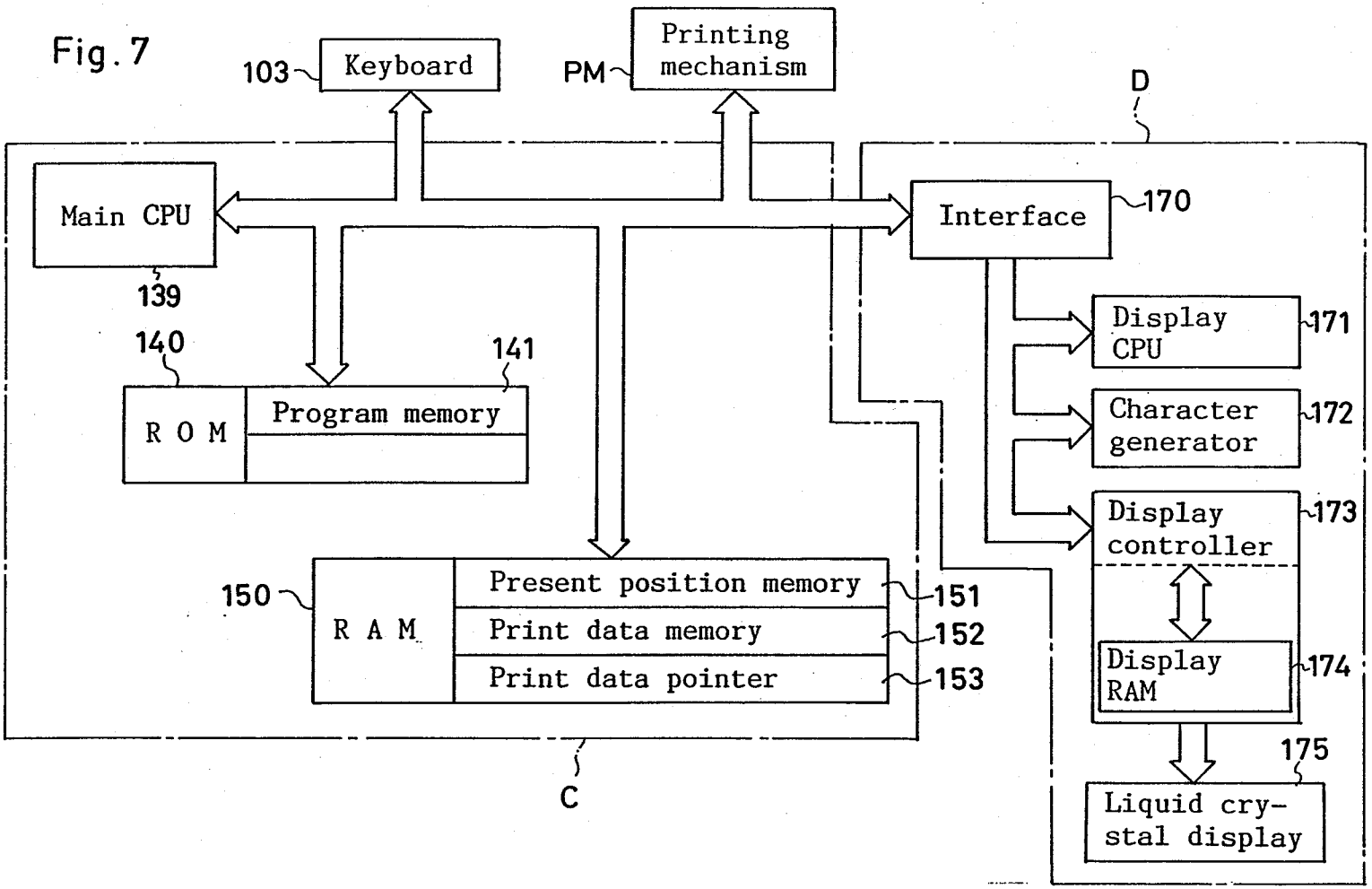

The entire construction of the control system of this electronic typewriter 101 is described below with reference to the block diagram in FIG. 7.

The electronic typewriter 101 comprises basically the keyboard 103, the printing mechanism PM, the display mechanism D, and a control unit C. The keyboard 103, the printing mechanism PM, and the display mechanism D are connected to the main CPU (central processing unit) 139 of the control unit C through data bus 160, etc.

The control unit C is composed of the main CPU 139, and a ROM (read only memory) 140 and a RAM (random access memory) 150 which are connected to the main CPU 139 through data bus 160, etc.

A program memory 141 of the ROM 140 stores the control programs for controlling th printing mechanism PM and display mechanism D, so as to correspond to the code data entered from character keys 110 and function keys 114, 115 on the keyboard 103, and a control program for character erasure control described below.

The RAM 150 comprises a present position memory 151 for sequentially updating and storing the present position of the carriage 122 (printing head 127*a*) from the absolute origin with respect to the printing position, a print data memory 152 for storing about 500 characters sequentially by using the code data of printed characters and symbols, and the attribute data of underline, boldface or other information in two bytes, so as to correspond to the printing position, an input buffer 154 for storing the data such as characters input from the keyboard 103 and displayed on the display 175, a text memory 155 for storing the input data as file data, a cursor display position counter 156 for counting the cursor display position depending on the cursor movement so as to correspond to each display position of the display 175, a cursor position pointer 157 for indicating the address of the input buffer 154 so as to correspond to the data of the cursor display position counter 156, and a print data pointer 153 for searching the data of the address indicated in the print data memory 152.

The main CPU 139, according to the control program, controls the printing mechanism PM to print the characters and symbols corresponding to the data input from the character keys 110, and sequentially stores the print data in the print data memory 152 so as to correspond to the printing position.

When the erasure key 112 is operated, the main CPU 139 erases by controlling the printing mechanism PM to hammer the same printing type element of the type wheel 127 as the printed character through the correction ribbon 129, on the basis of the data of the present position memory 151 and the data of the print data memory 152. This erasing is executed by three times of hammering, that is, one hammering at the present position of the printing head 127*a*, second hammering at the position where the printing head 127*a* is moved for example 1/240 inch from the present position in the printing direction, and final hammering at the position where the printing head 127*a* is moved 1/240 inch from the present position in the antiprinting direction.

The display mechanism D is composed of an interface 170, a CPU 171 for displaying, a character generator 172, display controller 173, and the liquid crystal display 175, and is connected as shown in the drawing.

In the character generator 172, about 400 types of dot matrix display data for displaying characters and symbols are stored so as to correspond to the code data of characters and symbols.

The CPU 171 reads out the display data corresponding to the command data and character data outputted from the main CPU 139 through the interface 170, from the character generator 172, and outputs the display data to the display controller 173. The display controller 173, in turn, writes the display data into the display RAM 174, and, at the same time, outputs the display signal corresponding to the display data to the display 175. Furthermore, the CPU 171 also controls the cursor movement to indicate the address of the destination of the cursor movement to the display controller 173 depending on the cursor movement data from the main CPU 139.

[First Example of Character Erasure Control]

Figure 8:
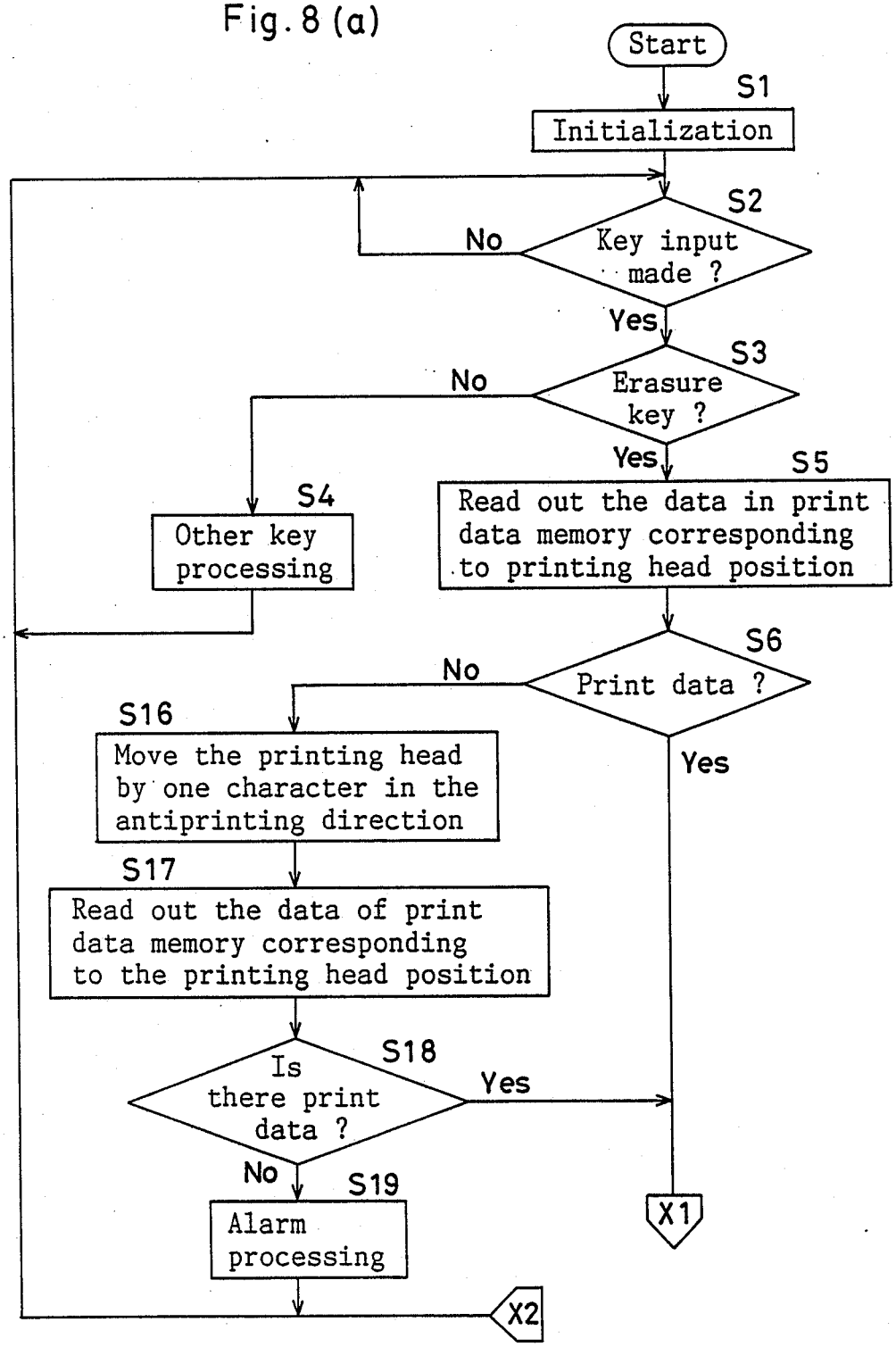
Figure 8:
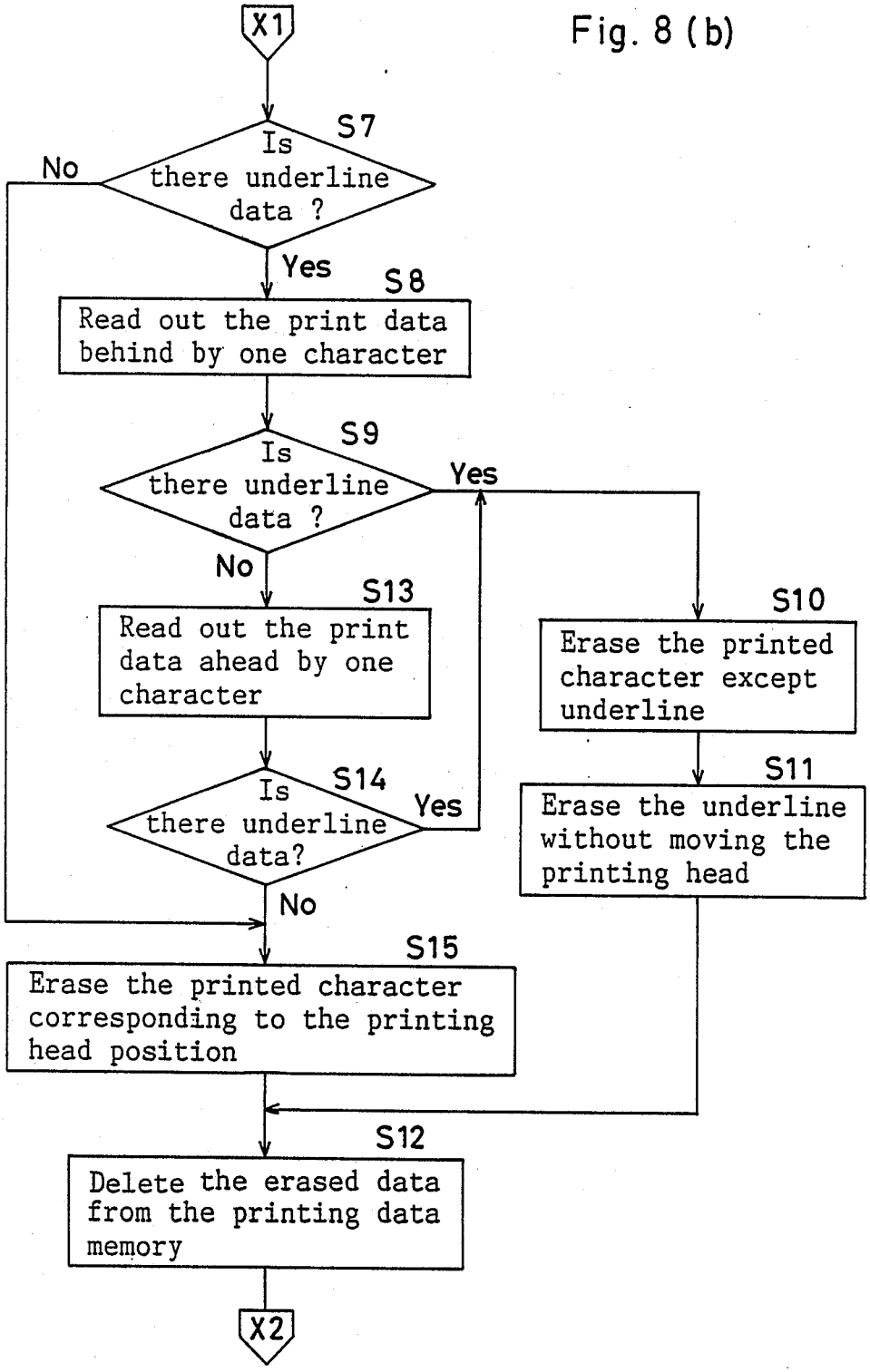
Figures 9, 10:
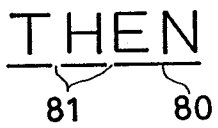

(FIGS. 8(*a*) and 8(*b*) to FIG. 10)

In this character erasure control, when erasing a character, if an underline is consecutively printed beneath the printed character to be erased and the next character in either printing or antiprinting direction, first the printed character is erased securely by moving the printing head 127*a* slightly ahead and behind so that the underline is erased only by the length corresponding to the width of the underline type.

Referring now to the flow charts in FIGS. 8(*a*) and 8(*b*), the character erasure control conducted by the control unit C of the electronic typewriter 101 is described below.

When the power is supplied to the typewriter 101, this control is started to proceed to step 1 (abbreviated S1 hereinafter, as are subsequent steps designated S2, S3, etc. to initialize, thereby waiting for a key input in S2. A key input causes to proceed to S3, where the key input is judged to be the erasure key 112 or not. If not the erasure key 112, for example, when a character key 110 is operated, the operation proceeds to S4, where the input data is printed and the printing data is stored in the print data memory 152 at the same time, thereby returning to S2. In this printing, the main CPU 139 outputs a control signal to each drive circuit 131, 133, 135, 137, 138 in th printing mechanism PM.

When the erasure key 112 is operated, it is judged Yes in S3, and the operation proceeds to S5. In S5, the data of the present position memory 151 is written in the print data pointer 153, and the data of the address corresponding to the printing head position in the print data memory 152 is read out according to the data of the print data pointer 153. In the next step S6, the data is judged to be print data or not, and when it is print data, the operation proceeds to S7.

In S7, it is judged whether the underline data is present or not, that is, whether the underline information bit provided in the lower byte of the read-out data is 1 or not, and if there is underline data, the operation proceeds to S8. In S8, one is subtracted from the print data pointer 153, and according to this data, the print data corresponding to the printing position behind by one character in the antiprinting direction from the printing head position in the printing data memory 152 is read out.

In S9, it is judged whether the underline data is present or not, that is, whether the underline is continuous or not, and if there is underline data, the operation proceeds to S10. For example, as shown in FIG. 9(*a*), the printing head 127*a* is located at the printing position of the character "B", and an underline is continuously printed beneath the characters "A" and "B".

In S10, the printed character except the underline is erased. For example, as shown in FIG. 9(*b*), the character "B" except the underline is erased in the ordinary erasure processing, that is, according to the character code of the character "B", by driving the type wheel 127 solenoid 128 and correction ribbon 129 of the printing mechanism PM, and by performing erasing action three times while moving the carriage 122 slightly right and left.

In S11, the underline is erased without moving the printing head 127*a*. For example, as shown in FIG. 9(*c*), while the printing head 127*a* is located at the printing position, the printing type element of the underline is hammered once or plural times through the correction ribbon 129, and the underline is erased. That is, the underline is erased only by the length corresponding to the portion of one character.

In S12, a space code is written in the address of the print data memory 152 corresponding to the erased data, and the data of the underline is deleted, and the data of erased character is deleted from the print data memory 152, the operation returns to S2.

Here, for correction printing, when a character key 110 is operated in the automatic underline mode, the character corresponding to the character key 110 is printed together with an underline in S4 by way of steps S2 to S3. For example, as shown in FIG. 9(*d*), the character "D" is printed together with an underline. In this printing, the underline is printed continuously without any interruption.

On the other hand, if the judgement is No in S9, the operation proceeds to S13. In S13, one is added to the print data pointer 153, and the print data corresponding to the printing position ahead by one character in the printing direction from the printing head position in the print data memory 152 is read out according to this data. In S14, it is judged whether there is underline data or not, that is, whether the underline is continuous or not. If there is underline data, the operation proceeds to S10, and the printed character except the underline is erased, and the underline is erased in the next step S11, and in S12 the data of erased character is deleted from the print data memory 152, thereby returning to S2. For example, as shown in FIG. 9(*a*), the printing head 127*a* is located at the printing position of the character "B", and the underline is continuously printed beneath the characters "B" and "C". In this case, first the character "B" and "C". In this case, first the character "B" is erased, and then the underline is erased only by the length corresponding to the portion of one character (see FIGS. 9(*b*) and 9(*c*)).

If judged to be No, in S7 or S14, that is, when the underline is not continuous, the operation proceeds to S15, and the printed character corresponding to the printing head position is (together with the underline if underlined) erased, and that data is deleted from the print data memory 152 in the next step S12, thereby returning to S2. For example, as shown in FIG. 10(*a*), when the printing head 127*a* is located at the printing position of character "B" and an underline is printed only beneath the character "B", the character "B" and the underline are erased, as shown in FIG. 10(*b*), according to the ordinary erasure processing, that is, the character code of character "B" and the underline information bit, by driving the type wheel 127, solenoid 128, and correction ribbon 129 of the printing mechanism PM, and performing erasing three times while moving the carriage 122 slightly right and left, and they are also deleted from the print data memory 152.

When judged to be No in S6, for example, in the case of a space code, the operation proceeds to S16, where the printing head 127*a* is moved by one character in the antiprinting direction. In the next S17, the data of the present position memory 151 is written in the print data pointer 153, and according to the data of this print data pointer 153, the data at the address corresponding to the printing head position of the print data memory 152 is read out. In the next step S18, it is judged whether print data is present or not, and when print data is present, the operation after S7 is repeated, and if not present, for example, in the case of the head data of the print data memory 152, the operation proceeds to S19, and a buzzer 162 is actuated by an alarm circuit 162*a*, and the operation returns to S2.

Thus, when erasing a character, if an underline is continuously printed beneath the printed character to be erased and the adjacent character on either side in the printing direction or the antiprinting direction, first the character is securely erased by moving the printing head 127*a* slightly right and left, and then the underline is erased without moving the printing head 127*a*, so that the underline is erased only by the length corresponding to the width of the underline type.

That is, when an underlined character is corrected and reprinted, a continuous and beautiful underline can be printed without interruption.

[Second Example of Character Erasure Control]

Figure 11:
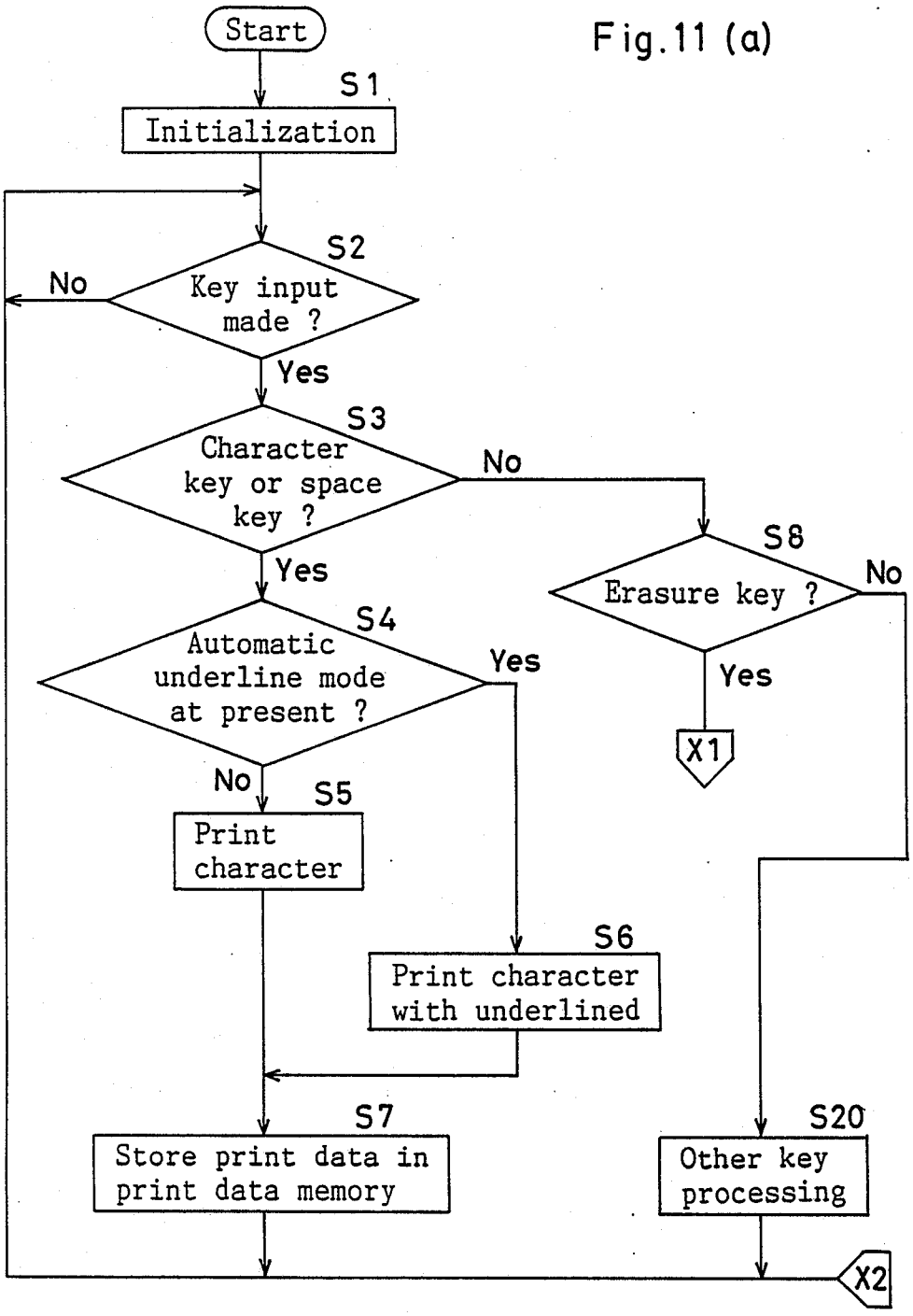
Figure 11:
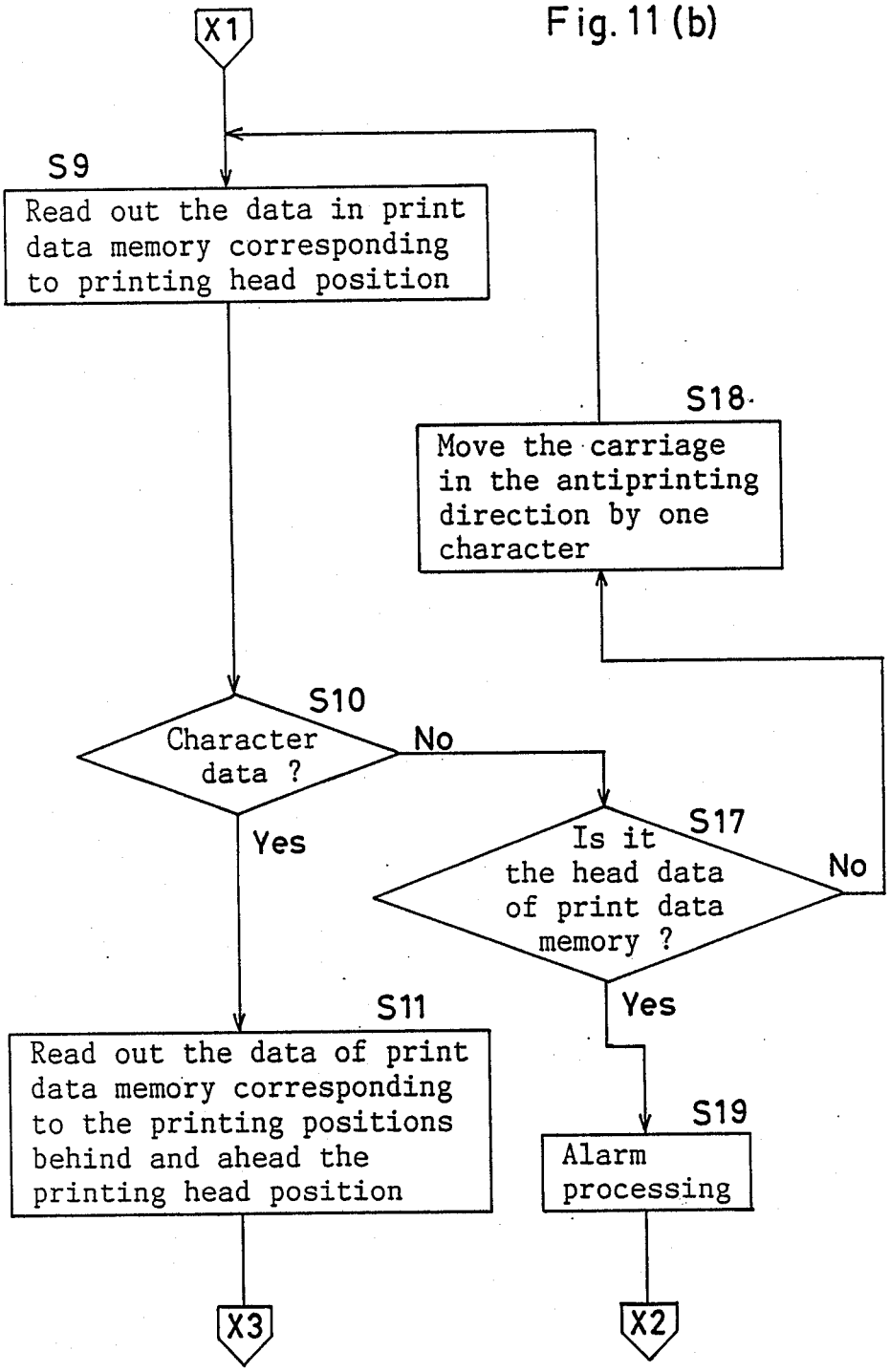
Figure 11:
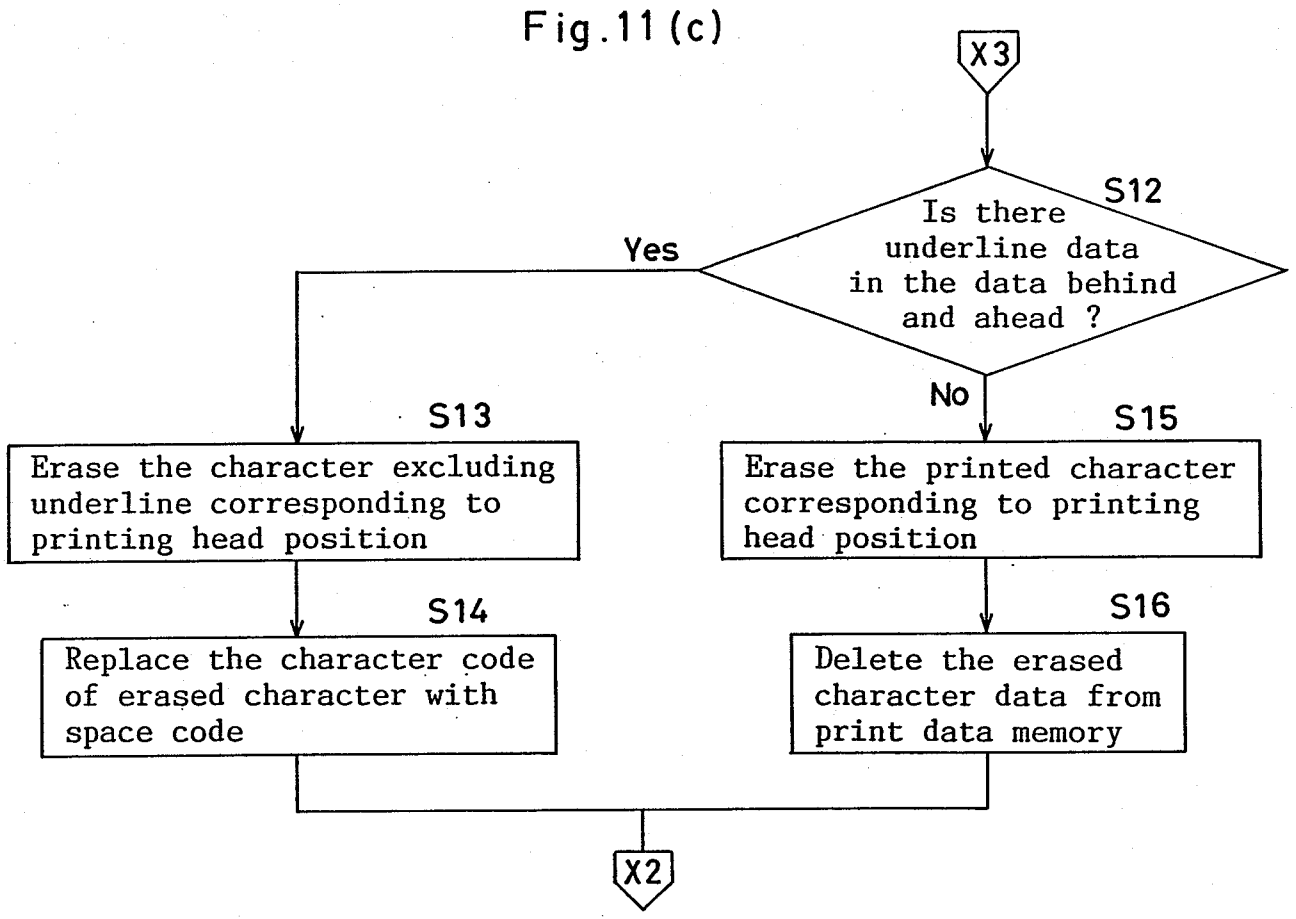

(FIG. 9 to FIGS. 11(*a*), 11(*b*) and 11(*c*))

In this character erasure control, when at least one of the printed characters behind and ahead the character to be erased (a printed character one stroke behind in the antiprinting direction and a printed character one stroke ahead in the printing direction) is underlined, even if the character to be erased is underlined, only the character is erased without erasing the underline. The RAM 150 has an underline mode flag which is set when the automatic underline mode is set.

This character erasure control is described below with reference to the flow charts in FIGS. 11(*a*), 11(*b*) and 11(*c*).

When the power is supplied to the typewriter 101, this control is started and in step S1 (abbreviated S1 hereinafter, as are subsequent steps designated S2, S3, etc.) the underline mode flag is reset and other initialization is executed, and the operation proceeds to S2. In S2, after waiting for a key input, when a key input is made, the operation proceeds to S3. In S3, the input key is judged to be whether a character key 110 or space key 111, and if Yes, in the next S4, it is judged whether the automatic underline mode is set or not, that is, whether the underline mode flag is set or not. When the automatic underline mode is not set (when the automatic underline flag is reset), the operation proceeds to S5. In S5, an ordinary character printing without underline corresponding to the input data is carried out, and the operation proceeds to S7.

Otherwise, in S4, when the automatic underline mode is set, the operation proceeds to S6, and the character corresponding to the input data is printed together with an underline and the operation proceeds to S7. Meanwhile, in S6, if an underline has been already printed at the printing position, duplicate printing of underline may be prevented by an underline stop control program which is stored in the program memory 141. In S7, the printing data corresponding to the input key is stored in the print data memory 152. Incidentally, in S6, when an underline is provided, the printing data is stored in the print data memory 152 together with the underline data, and the operation returns to S3. For example, as shown in FIG. 9(*a*), steps S2 to S4, S6 to S7 are repeated, and the character string "ABC" is printed together with an underline. When the erasure key 112 is operated, the operation proceeds to S8 by way of S2 to S3. In S8, judged to be Yes, the operation proceeds to S9, where the data at the address corresponding to the printing head position of the print data memory 152 is read out according to the data of the present position memory 151. In the next step S10, the data is judged to be whether the character data (including a space data with underline data) or not, and the operation proceeds to S11 if it is character data.

In S11, the data of the present position memory 151 is written in the print data pointer 153, and first the print data (the print data upper by one character than the printing head position) of the print data memory 152, which is obtained by subtracting one from the data in the print data pointer 153, is read out, and then the print data (the print data lower by one character than the printing head position) of the print data memory 152, which is obtained by adding two to the print data pointer 153 is read out. In the subsequent S12, it is judged whether or not there is underline data in any of the preceding and succeeding data being read out, that is, whether the underline information bit provided in the lower byte of the one character data in the print data memory 152 is 1 or 0, and the operation proceeds to S13 if there is underline data. In this state, for example as shown in FIG. 9(*a*), the printing head 127*a* is located at the printing position of character "B", and the underline is printed beneath the printed character "A" upper by one character than the printing head position and the printed character "C" lower by one character.

In S13, on the basis of the data of the present position memory 151 and the data of the print data memory 152, the print data excluding the underline data is deleted from the print data memory 152. At this time, according to the character code of the print data excluding the underline data, the type wheel 127, solenoid 128 and correction ribbon 129 of the printing mechanism PM are driven and the desired character is erased by performing plural times of erasing action while moving the carriage 122 slightly right and left. More specifically, first the correction ribbon 129 is located in the printing position, and the same printing type element as the character to be erased is located at the hammering position. The solenoid 128 is actuated, and the printing type element is hammered, and the printing ink is peeled off by the correction ribbon 129. Then the carriage 122 is moved to the right by 0.2 mm (1/120 inch), and a similar erasing action is carried out. Furthermore, moving the carriage 122 to the left by 0.4 mm (2/120 inch), an erasing action is carried out once more. After this erasing action, the carriage 122 is moved by 0.2 mm to the right, and returned to the original position, and the lifted correction ribbon 129 is set down, thereby terminating a series of erasing actions. For example as shown in FIG. 9(*b*), only the character "B" is erased. In the next S14, in the print data memory 152, the character code of the erased character is deleted, and a space code is written in, thereby returning to S2.

When printing a character in the erased position, if the automatic underline mode is presently effective, a correct character is printed, without printing the underline again, in steps S2 to S4, S6 to S7. For example, as shown in FIG. 9(*d*), only the correct character "D" is printed. On the other hand, if judged to be No in S12, the operation proceeds to S15. For example, as shown in FIG. 10(*a*), of the character string "ABC", an underline is printed only beneath the character "B" and the printing head 127*a* is located at the printing position of character "B". In S15, the printed character (including the underline) is erased according to the data of the present position memory 151 and the data of the print data memory 152. That is, on the basis of the character code of the printed data and the attribute data, the type wheel 127, solenoid 128 and correction ribbon 129 of the printing mechanism PM are driven, and the desired character (including the underline) is erased by performing plural times of erasing action while moving the carriage 122 slighty right and left. The erasure operation is carried out by three erasing actions accompanying slight positional changes as in S13. When the erasure processing is over, the operation proceeds to S16, and the print data of the erased character is deleted from the print data memory 152, and the operation returns to S2.

For example as shown in FIG. 10(*b*), the character "B" is erased together with the underline. When printing a correct character in the same position, if the automatic underline mode is set, a correct character is printed together with the underline through S2 to S4 and S6 to S7, and if not automatic underline mode, a correct character "D" is printed as shown in FIG. 10(*c*) through S2 to S5 and S7.

If judged to be No in S10, the operation proceeds to S17, and it is judged whether the data is the beginning data in the print data memory 152 or not, and if judged to be the beginning data, it is unable to erase the character, and the operation returns to S2 after alarm processing in S19. In S17, if the print data is not the beginning data of the print data memory 152, the operation proceeds to S18. In S18, on the basis of the data of the present position memory 151 and the data of the print data memory 152, the carriage 122 is moved by one character in the antiprinting direction, and the operation proceeds to S9. That is steps S9 to S10, S17 to S18 are repeated, and as far as the character erasure is not impossible, search continues in the antiprinting direction while character data is detected. Hence, if the printing head 127*a* is at the position after tab operation or space operation, the character data can be automatically detected.

Meanwhile, if other keys than the character keys 110, space key 111, and erasure key 112 are operated, the result of judgment in S8 is No, and, in S20, processing corresponding to the operated key, for example, setting or cancellation of the automatic underline mode is executed, and the operation returns to S2.

Thus, if at least one of the printed characters behind and ahead the character to be erased (the printed characters upper by one position to the antiprinting direction and lower by one position to the printing direction) is underlined, only the character is erased and the underline is not erased, so that a continuous and beautiful underline can be printed without interruption.

What is claimed is:

1. A character erasable printing apparatus comprising:

input means for inputting data regarding characters and symbols and commands;

printing means having a printing head movable in a predetermined printing direction for printing a character or symbol corresponding to an input data on a printing medium;

automatic underline mode setting means for setting an automatic underline mode in said printing means;

print data memory means for storing code data and underline data of the characters, symbols and underline printed by said printing means corresponding to their printing positions;

reading means for reading out the code data of the characters and symbols and underline data stored in said print data memory means;

erasing means for erasing a character or symbol from said printing medium, by operation of said printing means according to the code data being read out by said reading means, when an erasure command is inputted from said input means; and erasure control means for controlling said reading means to read out only the code data of the printed character or symbol corresponding to the present printing position of said printing head from said print data memory means, when said erasure command is received in the automatic underline mode, and for controlling said erasing means to erase the printed character or symbol corresponding to the read-out code data in such a manner that the printed underline remains unerased.

2. A character erasable printing apparatus according to claim 1; wherein said print data memory means stores the data relating to each character or symbol in two bytes, putting the code data of the character or symbol in the upper byte, and the underline data, bold data, printing head shift stroke data, printing hammer impact force data and the like in the lower byte.

3. A character erasable printing apparatus according to claim 1; wherein said erasure control means controls the code data of a printed character and the underline data if present to be read out from said print data memory means, when said erasure command is inputted in a mode other than said automatic underline mode, and controls said erasing means to erase the character or symbol and the underline corresponding to the present printing position of said printing head.

4. A character erasable printing apparatus according to claim 1; wherein said erasure control means commands said printing means to move said printing head to one stroke upper printing position when the code data read out from said print data memory means is space code or there is no code data relating to the character or symbol, and controls said reading means to read out the code data of the printed character at said one stroke upper printing position.

5. A character erasable printing apparatus comprising:

input means for inputting data regarding characters and symbols and commands;

printing means having a printing head movable in a predetermined printing direction and including plural printing types and a printing hammer, and a printing ribbon for printing a character or symbol corresponding to an input data on a printing medium;

print data memory means for storing code data and underline data of the characters, symbols and underline printed by said printing means corresponding to the printing position;

present position memory means for storing a present position of said printing head corresponding to the printing position;

erasing means for erasing a character or symbol from said printing medium by hammering the same printing type as the character or symbol at the present position of said printing head by said printing hammer through an erasure printing ribbon, at the present position where said printing head is moved slightly behind and ahead, on the basis of the data of said print data memory means and the data of said present position memory means, when an erasure command is inputted from said input means;

judging means for reading out the underline data of the present position of said printing head and at least one position of one stroke upper printing position and one stroke lower printing position, from said print data memory means on the basis of the data of said present position memory means when said erasure command is inputted and for judging whether or not printed characters or symbols of these positions are underlined; and erasure control means for controlling said erasing means to erase only the printed character without erasing the underline, if said printed character is underlined, when at least one of the printed characters at both sides of said printed character is judged to be underlined by said judging means.

6. A character erasable printing apparatus according to claim 5; wherein when said printed characters at both sides are judged not to be underlined and said printed character is judged to be underlined, upon receiving said erasure command, said erasure control means controls said erasing means to erase said printed character and its underline.

7. A character erasable printing apparatus according to claim 5; further comprising an automatic underline mode setting means for setting an automatic underline mode in said printing means.

8. A character erasable printing apparatus according to claim 5; wherein said erasure control means, after controlling said erasing means to erase only the printed character without erasing the underline, stores a space code in said print data memory means in place of the code data of the printed character.

9. A character erasable printing apparatus according to claim 5; wherein said print data memory means stores the data relating to each character or symbol in two bytes, putting the code data of the character or symbol into the upper byte, and the underline data, bold data, etc. into the lower byte.

10. A character erasable printing apparatus according to claim 5; wherein said erasure control means, if there is no printed character or symbol at the present position of said printing head, commands said printing means to move said printing head to one stroke upper printing position, and reads out the code data of the printed character at the one stroke upper printing position.

11. A character erasable printing apparatus comprising:

input means for inputting data regarding characters and symbols and commands;

printing means having a printing head movable in a predetermined printing direction and incuding plural printing types and a printing hammer, and a printing ribbon for printing a character or symbol corresponding to an input data on a printing medium;

print data memory means for storing code data and underline data of the characters, symbols and underline printed by said printing means corresponding to the printing position;

present position memory means for storing a present position of said printing head corresponding to theprinting position;

erasing means for erasing a character or symbol from said printing medium by hammering the same printing type as the character or symbol at the present position of said printing head by said printing hammer through an erasure ribbon, at the present position and the positions where said printing head is moved slightly behind and ahead, on the basis of the data of said print data memory means and the data of said present position memory means, when an erasure command is inputted from said input means;

search means for searching the underline data of the present position of said printing head and at least one position of one stroke upper printing position and one stroke lower printing position with reference to the present position from said print data memory means on the basis of the data of said present position memroy means when said erasure command is received; and underline erasure control means for controlling said erasing means to erase the underline at said present position without moving said printing head slightly behind and ahead when the underline data is detected at the present position of said print head, and said one stroke upper printing position or said one stroke lower printing position by said search means.

12. A character erasable printing apparatus according to claim 11, wherein when the underline data is not detected at both of said one stroke upper printing position and said one stroke lower printing position by said search means and said printed character is underlined, said underline erasure control means controls said erasing means to erase said printed character and the underline attached to the printed character with moving said printing head slightly behind and ahead.

13. A character erasable printing apparatus according to claim 11; further comprising an automatic underline mode setting means for setting the automatic underline mode in said printing means.

14. A character erasable printing apparatus according to claim 11; wherein said print data memory means stores the data relating each character or symbol in two bytes, putting the code data of the character or symbol in the upper byte, and the underline data, bold data, etc. in the lower byte.

15. A character erasable printing apparatus according to claim 11, wherein said erasure control means, if there is no printed character or symbol at the present position of said printing head, commands said printing means to move said printing head to said one stroke upper printing position, and reads out the code data of the printed character at said one stroke upper printing position.

* * * * *